United States Patent [19]

Dijkhuizen

[11] Patent Number: 4,856,125

[45] Date of Patent: Aug. 15, 1989

[54] CLEANING DEVICE FOR THE PIPING SYSTEM OF A WHIRLPOOL TUB OUTLET VALVE THEREFOR

[75] Inventor: Okko K. Dijkhuizen, Roden, Netherlands

[73] Assignee: Ucosan B.V., Roden, Netherlands

[21] Appl. No.: 109,617

[22] Filed: Oct. 19, 1987

[51] Int. Cl.[4] ..... A61H 33/02

[52] U.S. Cl. ..... 4/543; 4/490; 134/169 C

[58] Field of Search ..... 4/490, 541, 542, 543, 4/544; 134/22.12, 24, 166 C, 169 C

[56] References Cited

U.S. PATENT DOCUMENTS

| | | | |
|---|---|---|---|
| 3,967,323 | 7/1976 | Serio | 4/541 |
| 4,264,039 | 4/1981 | Moreland | 4/542 X |
| 4,383,341 | 5/1983 | Altman | 4/541 X |
| 4,527,585 | 7/1985 | Mirabile | 134/169 C X |
| 4,563,781 | 1/1986 | James | 4/542 |
| 4,586,204 | 5/1986 | Daniels | 4/542 |

FOREIGN PATENT DOCUMENTS

| | | |
|---|---|---|
| 0042591 | 12/1981 | European Pat. Off. . |
| 8416982 | 6/1986 | Fed. Rep. of Germany . |
| 302791 | 1/1955 | Switzerland . |
| 1015109 | 12/1965 | United Kingdom . |

*Primary Examiner*—Philip R. Coe

*Attorney, Agent, or Firm*—Wenderoth, Lind & Ponack

[57] ABSTRACT

The invention relates to a cleaning device for a piping system of a whirlpool tub where one or more outlet valves supply water and/or air into the interior of the tub. The outlet valves branch off from a cleaning-fluid circulation system using a delivery pump to circulate the cleaning fluid. When the cleaning fluid is circulated the outlet valves are in a closed position, receiving a flow of the cleaning fluid, but preventing the issuance of the cleaning fluid into the tub interior. The outlet valve has a water-supply line connecting into a water-distribution chamber disposed in a valve body, from which a water-outlet channel branches toward the tub interior. The water-outlet channel guides, in a watertight and axially movable manner, a sealing member passing through the water-distribution chamber. The sealing member has a smaller cross section than the water-distribution chamber, and an end face of the sealing remember, when in a closed position, is precisely flush with or bulges just slightly beyond an adjoining end face of the valve body.

16 Claims, 4 Drawing Sheets

CLEANING DEVICE FOR THE PIPING SYSTEM OF A WHIRLPOOL TUB OUTLET VALVE THEREFOR

BACKGROUND OF THE INVENTION

The invention relates to a cleaning device for a piping system of a whirlpool tub, the piping system having one or more outlet valves preferably disposed in the bottom region of the tub for the supply of water and/or air into the tub interior.

Cleaning devices for the piping system of a whirlpool tub having one or more outlet valves for supplying water and/or air into the interior of the tub are known, for example, from West German Utility Model 84-16,982. The tub of the Utility Model has a tub exit opening in the tub bottom, as well as swirl nozzles mounted in a well region for introducing water or a water-air mixture. At least one suction opening is disposed in the wall region, the suction opening and the swirl nozzles being connected by pipes with the suction side and pressure side, respectively, of a pump disposed on the tub. The tub exit opening is provided with an exit connection for a drain line connected to the pump. The pump is disposed on the tub at a level above the exit connection, and a shut-off valve having a controllable operator is disposed in the drain line. It is intended that, whenever the water is changed, preliminary flushing of the internal piping system be performed before operation of the whirlpool tub is started. Due to the many parts and the required control system, this cleaning device is relatively expensive to make and install. Because of the required level of the pump, the cleaning device requires a certain minimum amount of space, which may not always be available. Moreover, during the preliminary flushing process, water is used which comes from the tub interior, allowing dirt to be carried into the piping system. The addition of cleaning agents, as is necessary in cases of germ colonies and similar contamination of the piping system, is not possible unless the time consuming step of specially filling the tub were to be undertaken.

OBJECTS OF THE INVENTION

The object of the present invention is to provide a cleaning device of the type mentioned in the introduction which is simple to make, install and operate, and which permits reliable cleaning of the piping system.

SUMMARY OF THE INVENTION

This object is achieved by the invention by having outlet valves branch off from a cleaning-fluid circulation system that contains a delivery pump but is not in communication with the tub interior. A closed valve position of the outlet valves conveys a flow of the cleaning fluid but prevents the issuance of the cleaning fluid into the tub interior.

The cleaning device thus comprises few parts. A section of the circulation system is formed by those pipes which are in any case necessary to supply water through the outlet valves (in their open position) to the tub interior, so that only the circulation system must still be led back to the delivery pump. The cleaning fluid which circulates in the circulation system gets into all cavities of the outlet valves and the pipes, so that complete and reliable cleaning occurs. Before the whirlpool system is used again the cleaning fluid is removed from the circulation system.

In a specific embodiment of the invention, the circulation system has two essentially parallel pipe branches, preferably running in the longitudinal direction of the tub below the tub. The outlet valves branch off from one pipe branch (the outgoing branch). Return lines (flushing lines) connect into the other pipe branch (recirculation branch) from each of the outlet valves. In this way, complete flushing and cleaning of the outlet valves and the piping system is ensured and a space saving arrangement of the circulation system is provided.

A fresh water line can be connected into the circulation system, preferably into the recirculation branch. This serves to make available the necessary water for cleaning, reflushing and supplying the outlet valves during whirlpool operation. The fresh water line is preferably connected into a water tank, which then functions as a reservoir. A connecting line branches off from the water tank to the circulation system.

The circulation system, preferably the recirculation branch, has a cleaning agent supply line connected thereto, whereby the supply of cleaning agent to the fresh water is simplified.

In a preferred embodiment of the invention, the circulation system is in fluid communication, preferably at the position farthest removed from the delivery pump, with the water drain of the tub. The spent cleaning fluid can then be removed via the tub drain. The tub drain can be opened and closed to the circulation system.

For a secure installation, the outgoing line and the recirculation line are preferably linked together by spacer elements at certain intervals. This is advisable considering the length of the lines.

In a structurally simple embodiment of the invention, the connections for the outlet valves and/or the return lines and/or the fresh water line or connecting line and/or the cleaning agent supply line can be formed integrally with spacer elements.

Installation is even further simplified by providing the spacer elements with sleeve shaped sections through which the outgoing line or the recirculation line is guided.

The outlet valve according to the invention for the water and/or air supply of the whirl pool tub, especially for the cleaning device of the type discussed above, will now be described. A water supply line connects into a water-distributing chamber disposed in a valve body. A water-outlet channel branches off from the chamber toward the tub interior. The water outlet channel guides, in a watertight manner, an axially movable sealing member, preferably cylindrical, which passes through the water-distributing chamber and has a smaller cross section than the water-distributing chamber. The end face of the sealing member is at least flush with the adjoining end face of the valve body, i.e. precisely flush with the adjoining end face of the valve body or bulging just slightly beyond it, when the sealing member shuts off the water-outlet channel. The outlet valve therefore, with the sealing member in the closed position, permits complete shut off of the cleaning device from the tub interior. The valve also prevents cavities in which residual water could remain and/or germ deposits form from being formed in the outlet valve or directly above the outlet valve. In the open position, the sealing member opens the passage to the tub interior for operation of the whirlpool. The advantage of the invention is that one part of the outlet valve can convey a flow of the cleaning fluid of the cleaning device, while no recesses in which residual water from the tub interior could collect remain directly above the outlet valve.

In a preferred embodiment of the invention a return line (flushing line) branches off from the water distributing chamber, the return line being in fluid communication with the water-supply line when the sealing member is in the closed position. The water distributing chamber can then be flushed by the cleaning fluid during the cleaning operation. The water-outlet channel is completely occupied by the sealing member when the sealing member is in its closed position, being substantially flush with the tub bottom so that water accumulations are prevented. Preferably, the sealing member passes completely through the valve body in the axial direction of the valve body, and thus also through the water distributing chamber. The lower end of the sealing member is connected with either a pneumatically, hydraulically or magnetically operated piston so as to easily move the sealing member between its closed and open positions.

The valve body and/or the valve housing may include an air distributing chamber annularly surrounding the water-distributing chamber. An air-supply line connects to the air distributing chamber. An air-outlet channel, which may be annular, branches off from the air distributing chamber. The air-outlet channel movably guides a shut-off member in an airtight and watertight manner. The shut-off member is preferably in the form of a hollow cylinder, passing through the air distributing chamber. An end face of the hollow cylinder when in a closed position, is at least flush with the adjoining end face of the valve body or valve housing. Thus no detrimental water residue can collect in the region of the air supply.

Preferably, the shut-off member passes completely through the valve body in the axial direction of the valve body. The lower end of the shut off member is connected with either a pneumatically, hydraulically or magnetically operated piston. This can be the same piston as that of the sealing member. The piston is preferably axially guided in the valve housing.

Further objects, features, advantages and possible applications of the present invention will be apparent from the following description of the preferred embodiment with reference to the accompanying drawings.

DETAILED DESCRIPTION OF THE INVENTION

Figure 1:
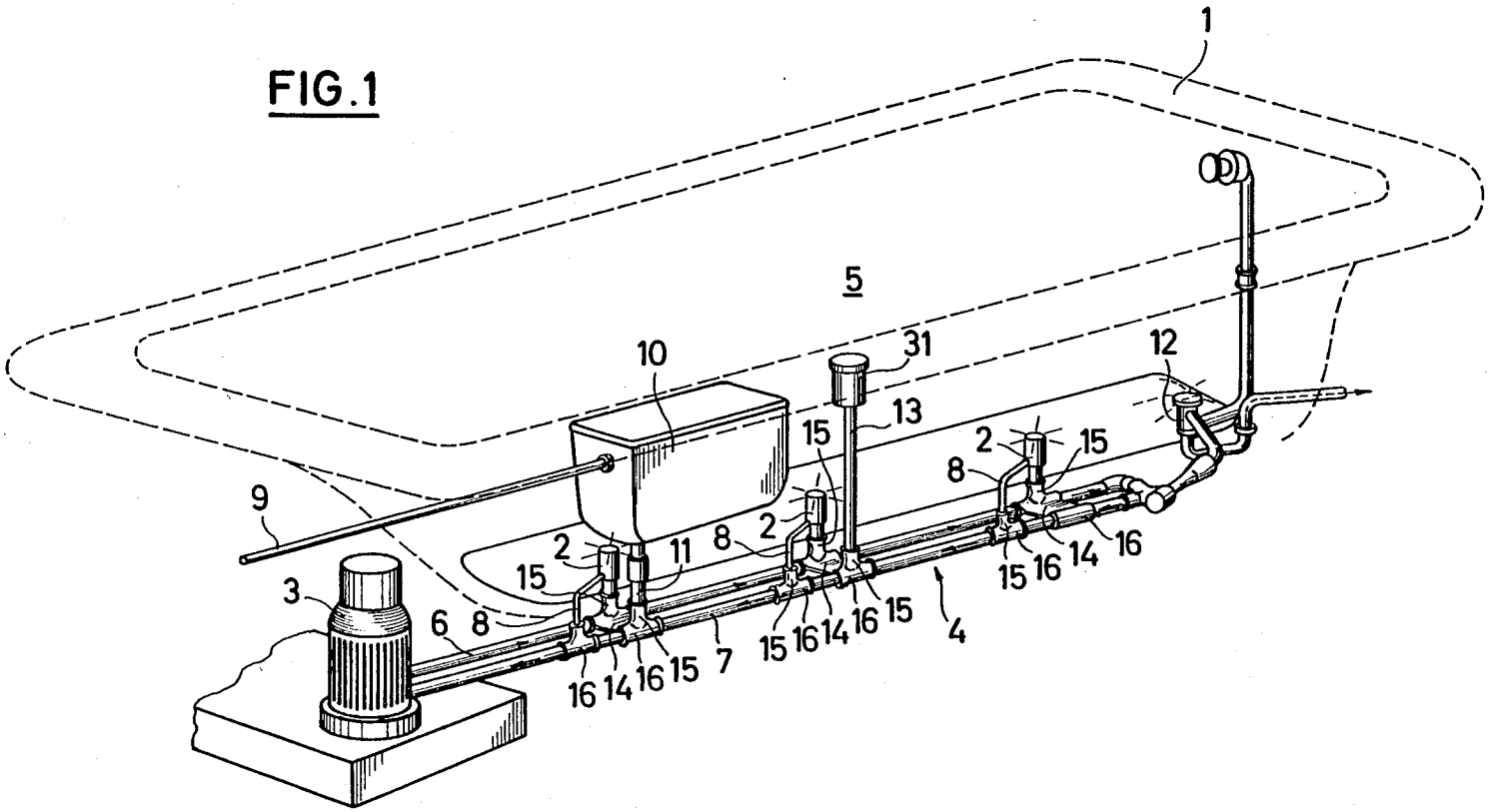
FIG. 1 is a perspective view of a cleaning device according to the invention in relationship to a whirlpool tub.

A cleaning device is shown in FIG. 1 for a piping system of a whirlpool tub 1. A plurality of outlet valves 2 supply water and/or air into the interior 5 of the tub 1, and are disposed in the bottom region of the tub. The outlet valves 2 branch off from a circulation system 4 provided for a cleaning fluid, the circulation system including a delivery pump 3. The system is shut off from communication with the tub interior 5 when the outlet valves are in a closed position. This allows a flow of the cleaning fluid while preventing the issuance of cleaning fluid into tub interior 5. The circulation system 4 has two substantially parallel pipe branches 6 and 7 running under the tub 1 to save space, and in the longitudinal direction of the tub. From pipe branch 6 (outgoing branch) branch off the outlet valves 2. From each of the outlet valves 2, return lines 8 (flushing lines) connect into pipe branch 7 (recirculation branch). This arrangement ensures that during a cleaning operation, not only the entire piping system, but also cavities in the outlet valves 2, receive a flow of cleaning fluid. A fresh water line 9 connects to a water tank 10, from which a connecting line 11 branches off to the circulation system 4.

A cleaning agent supply line 13 also connects into the recirculation branch 7, the supply line 13 carrying a cleaning agent container 31 accessible to the user at its upper end. The cleaning-agent supply can be designed such that detergents and the like placed in the supply are gradually drawn into the circulation system 4 by means of the venturi principle during circulation of the cleaning fluid in the circulation system 4. At the end of the two parallel pipe branches 6, 7, remote from the delivery pump 3, the circulation system 4 is in fluid communication with a tub drain 12. Discharge of fluid in the circulation system 4 can then easily be achieved. The tub drain 12 can be closed and opened relative to the circulation system 4.

The outgoing branch 6 and the recirculation branch 7 are linked together at approximately equal intervals by means of spacer elements 14, so that a stable unit is produced. Connections 15 for the outlet valves 2 and/or the return line 8 and/or the connecting line 11 and/or the cleaning-agent supply line 13 are formed integrally with the spacer element 14, thus permitting simple installation.

The spacer elements also have sleeve-shaped sections 16, through which the outgoing line 6 or the recirculation line 7 is guided, thus further simplifying the installation.

Figure 2:
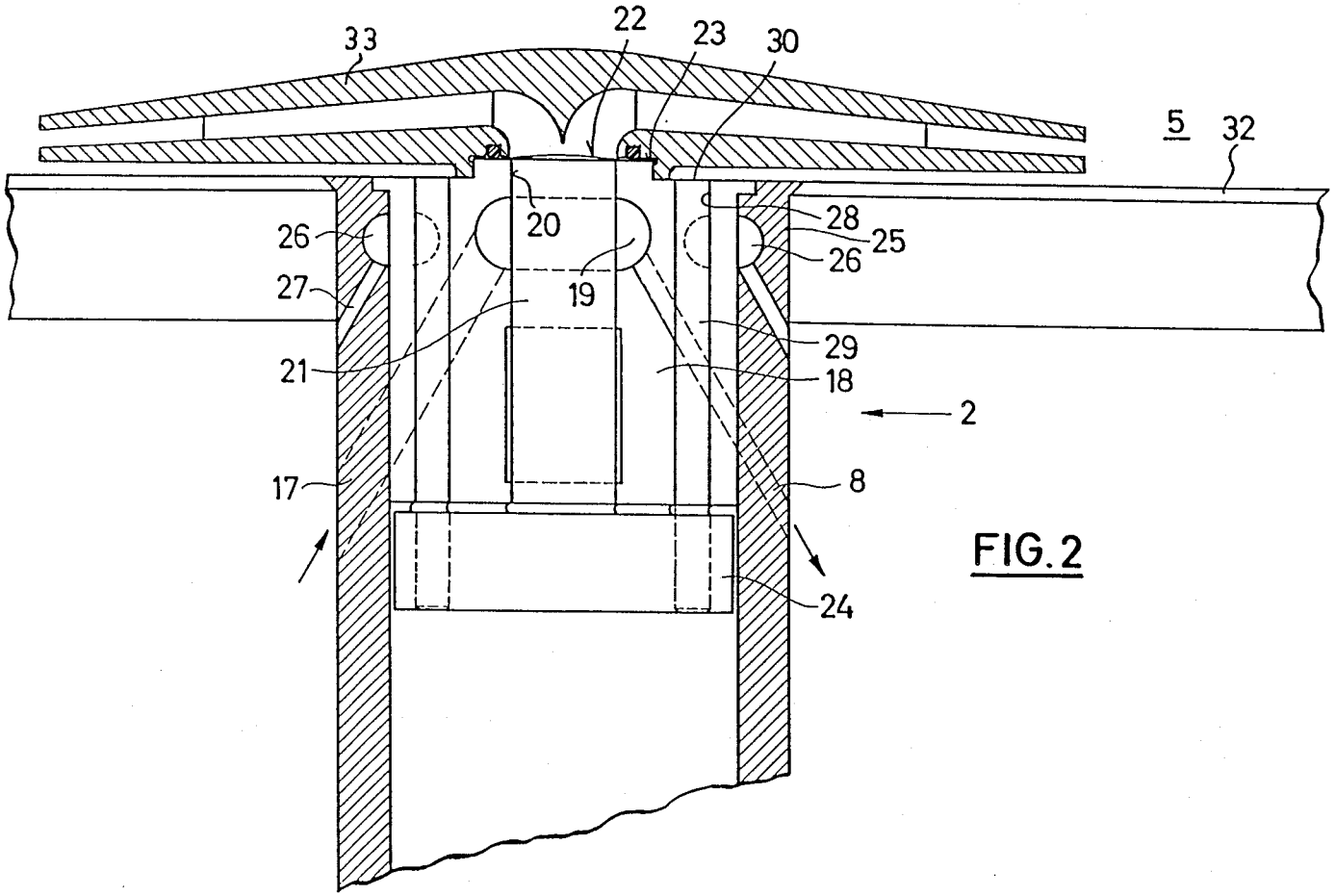
FIG. 2 is a sectional view of a first embodiment of an outlet valve according to the invention.

FIG. 2 shows an outlet valve 2 for whirlpool tubs which is particularly suitable for the cleaning device described above. A water-supply line 17 for the outlet valve 2 connects into a water-distributing chamber 19 disposed in a valve body 18. A water-outlet channel 20 branches off at right angles from the water-distribution chamber 19 toward the tub interior 5. The water-outlet channel 20 guides in a watertight manner an axially movable cylindrical sealing member 21 passing through the water-distributing chamber 19. The sealing member 21 has a smaller cross section than the water distributing chamber 19, so that, even when the sealing member 21 is in a closed position, an annular portion of the water-distributing chamber 19 remains free. An end face 22 of the sealing member 21 is at least flush with an adjoining end face 23 of the valve body 18 when in the closed position, as shown in the drawing. Thus, if the valve housing 25 and the valve body 18 are inserted into the tub bottom 32 without leaving a recess, as shown in the drawing, no recesses remain in the valve region in which detrimental residual water could collect. From the water-distributing chamber 19 branches off the return line 8 (flushing line) which, because of the free annular portion of the water-distributing chamber 19, is in fluid communication with the water-supply line 17 even when the sealing member 21 is in the closed position. In this manner, especially with the cleaning device described above, even the internal cavities of the outlet valve 2 can receive a flow of cleaning fluid.

The sealing member 21 passes completely through the valve body 18 and, at its end facing away from the tub, is connected with either a pneumatically, hydraulically or magnetically operated piston 24. By axial operation of the piston 24, the sealing member 21 can thus be easily moved downward from the illustrated closed position to an open position at which the water supplied via the water-supply line 17 issues from the water-outlet channel 20 into the tub interior 5. There is additionally mounted a nozzle body 33 on the valve body 18.

In the valve body 18 and the valve housing 25 is, annularly surrounding the water-distributing chamber 19, an air-distributing chamber 26. An air-supply line 27 connects into the chamber 26, and an air-outlet channel 28, annularly surrounding the water outlet channel 20, branches off from the chamber 26. The air outlet channel 28 axially guides in an airtight and watertight manner, an axially movable hollow cylindrical shut-off member 29 for movement through the air-distributing chamber 26. An end face 30 of the shut-off member 29, when the shut off member is in a closed position, is also at least flush with the adjoining end face 23 of the valve body 18 or valve housing 25. Thus no water can collect in the closed position of the shut-off member 29. The shut-off member 29 also passes completely through the valve body 18, and at its lower end is connected with the piston 24, which in turn can be axially guided in the valve housing 25. The water and air supplies are controlled such that the sealing member 21 can be brought into the open position only when air pressure is present. Conversely, the air pressure can be shut off only when the sealing member 21 is in the closed position. Relatively strong closing forces are provided for the outlet valve 2, in order that a hermetic seal of the tub interior 5, with respect to the circulation system 4, is always insured with the sealing member 21 and th shut-off member 29 being in the closed position.

Figure 3A:
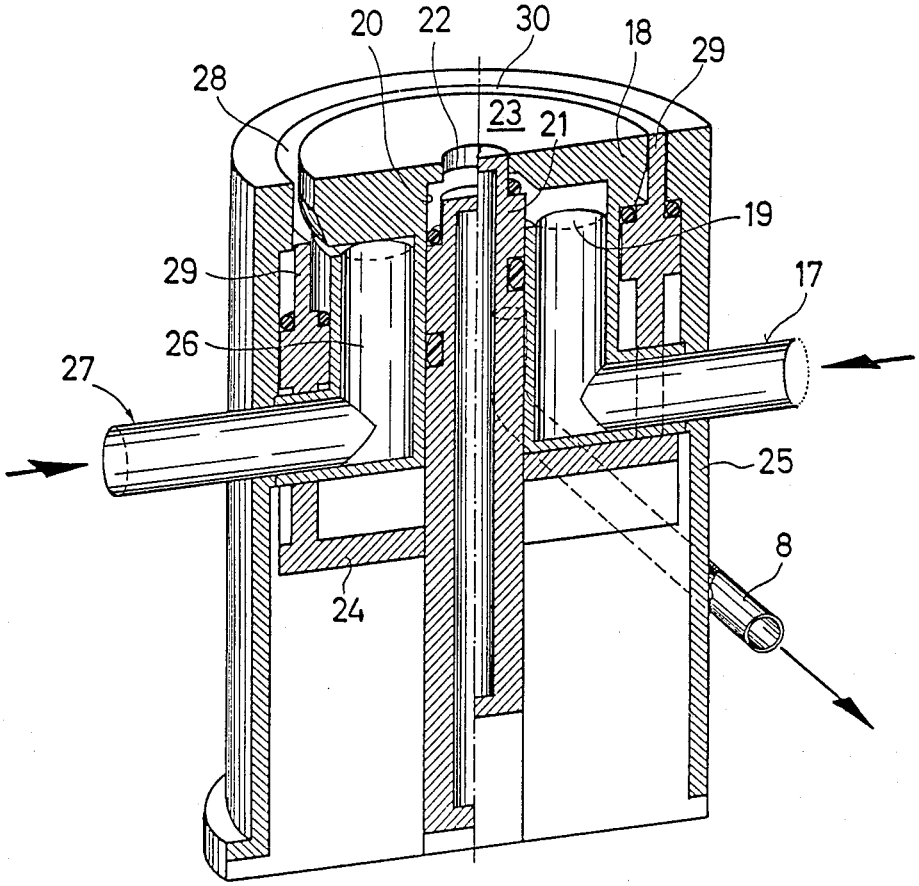
FIG. 3*a* is a perspective sectional view of a second embodiment of an outlet valve according to the invention.
Figure 3B:
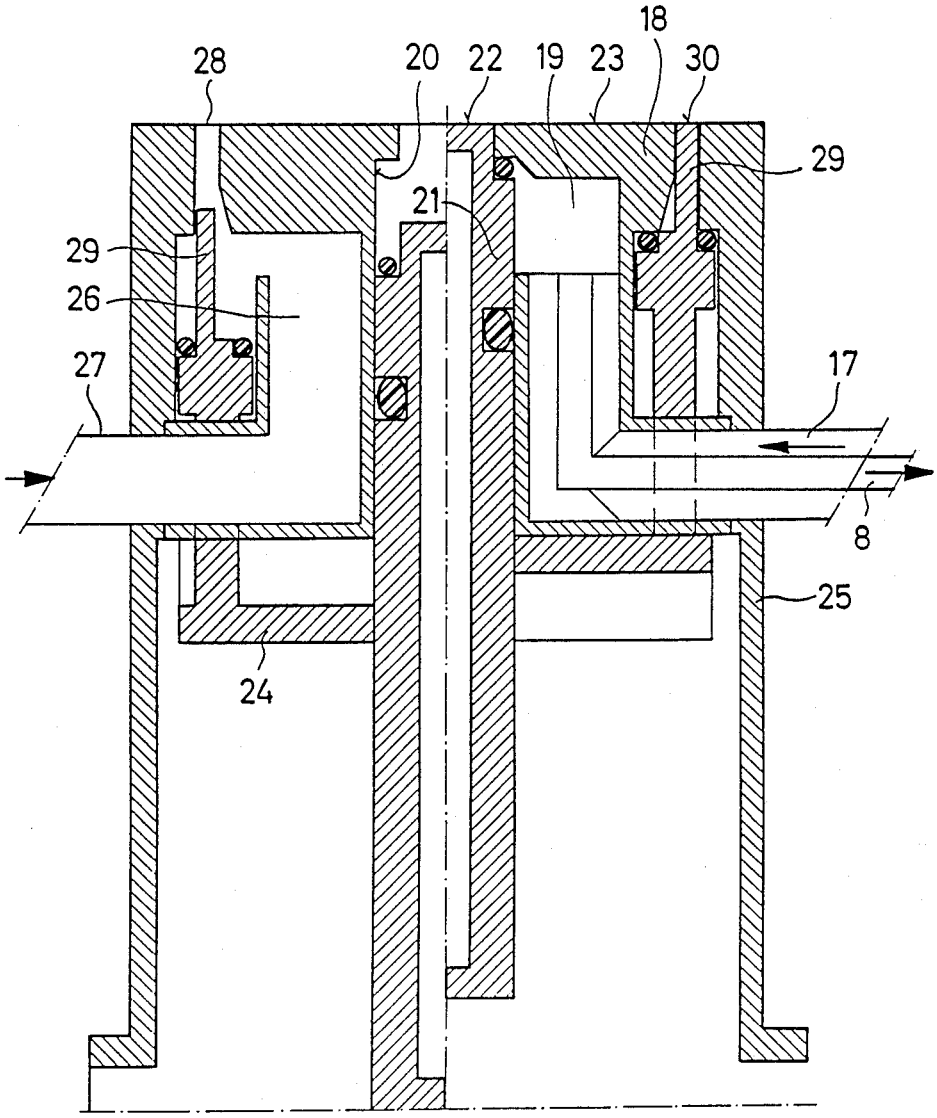
FIG. 3*b* is an elevational and sectional vie of the outlet valve of FIG. 3*a*.

The embodiment of the outlet valve 2 illustrated in FIGS. 3*a* and 3*b* functions in principle precisely as the outlet valve 2 according to FIG. 2. Only the interrelationship of the individual components, lines and chambers is somewhat altered. Packing rings provide reliable sealing of the sealing member 21 and the shut-off member 29 with the valve body 18 and the valve housing 25 in the closed position. In the left halves of FIGS. 3*a* and 3*b* are illustrated the open position for water and air issuance into the tub interior 5, and on the right halves are illustrated the closed position wherein flushing of the valve interior is nevertheless possible, via the flushing line 8.

I claim:

1. A cleaning system for a piping system of a whirlpool tub, said piping system having a delivery pipe means for delivering a flow of water to at least one outlet disposed in said whirlpool tub, the cleaning system comprising:

a circulation means for circulating a flow of cleaning fluid through said piping system of said whirlpool tub, said circulation means including a pump means for pumping said cleaning fluid through said piping system; and each said outlet having an outlet valve means for closing said outlet upon circulation of said cleaning fluid through said piping system to prevent issuance of said cleaning fluid into said whirlpool tub, said outlet valve means having a valve body and a valve member movably mounted in said valve body between a closed position closing said outlet and an open position opening said outlet, said valve member having an end face at least flush with an end face of said valve body when said valve member is in said closed position to thereby prevent the formation of a recess in said whirlpool tub at said outlet valve means when said outlet is closed by said outlet valve means.

2. The cleaning system as set forth in claim 1, wherein:

said valve body has a water outlet channel extending along a longitudinal axis of said valve body;

a water distributing chamber is formed in said valve body surrounding said water outlet channel, said water distributing chamber connected to said delivery pipe means via a water supply line; and said valve member is axially guided in said water outlet channel between said open and closed positions.

3. The cleansing system as set forth in claim 2, wherein:

a return line is connected between said water distributing chamber and said circulation means such that said return line is in fluid communication with said water supply line when said valve member is in said closed position to enable flow of said cleaning fluid from said water chamber to said return line.

4. The cleaning system as set forth in claim 2, wherein:

said water outlet channel extends completely through said valve body; and said valve member extends completely through said water outlet channel and is connected at an end of said valve member opposite said end face to a piston means for moving said valve member between said open and closed positions.

5. The cleaning system as set forth in claim 2, wherein:

said outlet valve means has a valve housing surrounding said valve body, said valve housing having an annular air distributing chamber connected to an air supply line and to a cylindrical air outlet channel;

said cylindrical air outlet channel extends in the direction of said longitudinal axis of said valve body and receives an axially movable cylindrical air shut-off member therein; and said air shut-off member is movable between an open position enabling air to enter said tub at said outlet and a closed position closing off said air distributing chamber from said air outlet channel and has an end face at least flush with an end face of said valve housing when said air shut-off member is in said closed position to thereby prevent the formation of a recess in said whirlpool tub at said outlet when said air outlet channel is closed by said air shut-off member.

6. The cleaning system as set forth in claim 5, wherein:

said air shut-off member is connected at an end of said air shut-off member opposite said end face to a piston means for moving said air shut-off member between said open and closed positions.

7. The cleaning system as set forth in claim 1, wherein:

said delivery pipe means includes a delivery pipe extending below said whirlpool tub and connected at one end to said pump means of said circulation means;

said circulation means further includes a recirculation pipe parallel to said delivery pipe and connected to said pump means;

each said outlet valve means is connected to said delivery pipe; and a return line is connected between each said outlet valve means and said recirculation pipe to enable said flow of cleaning fluid to circulate from said delivery pipe through each said outlet valve means and to said recirculation pipe.

8. The cleaning system as set forth in claim 7, wherein:

a fresh water supply line is connected to said circulation pipe to supply fresh water to the circulation means.

9. The cleaning system as set forth in claims 8, wherein:

said fresh water line is connected to said recirculation pipe via a water tank and a connecting line connected between said water tank and said recirculation pipe.

10. The cleaning system as set forth in claim 7, wherein:

a cleaning agent supply line is connected to said recirculation pipe.

11. The cleaning system as set forth in claim 7, wherein:

said delivery pipe and said recirculation pipe are connected at intervals along said pipes by a plurality of spacer elements.

12. The cleaning system as set forth in claim 11, wherein:

each said spacer element has integrally formed therewith a connection for connecting a said outlet valve to said delivery pipe and a connection for connecting a said return line to said recirculation pipe.

13. The cleaning system as set forth in claim 12, wherein:

one of said plurality of spacer elements has integrally formed therewith a connection for connecting a fresh water supply line to said recirculation pipe.

14. The cleaning system is set forth in claim 12, wherein:

one of said plurality of spacer elements has integrally formed therewith a connection for connecting a cleaning agent supply line to said recirculation pipe.

15. The cleaning system as set forth in claim 11, wherein:

each said spacer element has a sleeve-shaped section for guiding said delivery pipe and a sleeve shaped section for guiding said recirculation pipe.

16. The cleaning system as set forth in claim 1, wherein:

said whirlpool tub includes a water drain; and said circulation means is in fluid communication with said water drain.

* * * * *